US009874105B2

(12) United States Patent
Callaghan

(10) Patent No.: US 9,874,105 B2
(45) Date of Patent: Jan. 23, 2018

(54) ACTIVE CLEARANCE CONTROL SYSTEMS

(71) Applicant: United Technologies Corporation, Hartford, CT (US)

(72) Inventor: Craig M. Callaghan, East Granby, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 322 days.

(21) Appl. No.: 14/605,760

(22) Filed: Jan. 26, 2015

(65) Prior Publication Data

US 2016/0215648 A1 Jul. 28, 2016

(51) Int. Cl.
*F01D 25/12* (2006.01)
*F01D 11/24* (2006.01)

(52) U.S. Cl.
CPC ..... *F01D 11/24* (2013.01); *F05D 2260/201* (2013.01)

(58) Field of Classification Search
CPC ..... F01D 11/24; F01D 25/12; F05D 2260/201
See application file for complete search history.

(56) References Cited

U.S. PATENT DOCUMENTS 5,399,066 A * 3/1995 Ritchie ..... F01D 11/24 165/47
6,997,673 B2 * 2/2006 Morris ..... F01D 9/04 415/1
7,287,955 B2 * 10/2007 Amiot ..... F01D 11/24 415/173.2
7,597,537 B2 * 10/2009 Bucaro ..... F01D 11/24 415/136
8,092,146 B2 * 1/2012 Legare ..... F01D 11/24 415/1
2013/0156541 A1 6/2013 Eleftheriou et al.
2014/0112759 A1 4/2014 Casavant et al.

FOREIGN PATENT DOCUMENTS

EP 2551467 1/2013

OTHER PUBLICATIONS

Extended European Search Report dated Jun. 28, 2016 in European Application No. 16152729.6.

* cited by examiner

*Primary Examiner* — Ninh H Nguyen
(74) *Attorney, Agent, or Firm* — Snell & Wilmer, L.L.P.

(57) ABSTRACT

The present disclosure includes active clearance control systems including improved cooling manifolds. Such improved manifolds may utilize multiple cooling zones to provide varied levels of cooling to an engine case.

18 Claims, 4 Drawing Sheets

ACTIVE CLEARANCE CONTROL SYSTEMS

FIELD

The present disclosure relates generally to components of gas turbine engines and, more specifically, to active clearance control systems of gas turbine engines.

BACKGROUND

Gas turbine engine rotor blade tip clearances have a significant influence on engine performance. Leakage past the blade tips can be minimized by maintaining a desired or predetermined clearance between the blade tips and the case. Clearance can be selectively increased during specific portions of the flight to avoid contact between blade tips and the case. Thrust specific fuel consumption of the engine is thereby reduced and engine durability is increased.

Active clearance control (ACC) systems are frequently used to control blade clearance. ACC systems can provide cooling to certain areas of the engine case to shrink the engine case around the rotating compressor blades and thereby minimize the clearance between the case and blade tips.

Current ACC systems utilize manifolds having a uniform and consistent distribution of cooling holes. Such manifolds provide cooling air from outside of the engine case to the engine case itself. It may be desirable to provide an ACC with an improved manifold capable of tailoring cooling to particular portions of the engine case.

SUMMARY

An active clearance control system in accordance with various embodiments may comprise an engine case comprising an outer surface and a supply manifold mounted on the outer surface of the engine case and having a first cooling zone comprising a first arrangement of first cooling holes and a second cooling zone comprising a second arrangement of cooling holes, wherein the number of first cooling holes is different from the second arrangement of second cooling holes. The first cooling holes may be larger than at least one of the second cooling holes. The engine case may comprise a high or a low pressure turbine case. The active clearance control system may comprise a rotor having a plurality of blades adjacent to a shroud coupled to an inner surface of the engine case. Further, a tip clearance may be defined by the plurality of blades and the inner surface of the engine case.

A gas turbine engine section in accordance with various embodiments may comprise a turbine section an engine case comprising an outer surface, and a supply manifold mounted on the outer surface of the engine case surrounding the turbine section, wherein the supply manifold comprises a first cooling zone having a first arrangement of first cooling holes and a second cooling zone having a second arrangement of cooling holes, wherein the first arrangement of first cooling holes is different from the second arrangement of second cooling holes. The first cooling holes may be larger than at least one of the second cooling holes. The engine case may comprise a high or a low pressure turbine case. The active clearance control system may comprise a rotor having a plurality of blades adjacent to a shroud coupled to an inner surface of the engine case. Further, a tip clearance may be defined by the plurality of blades and the inner surface of the engine case.

A gas turbine engine in accordance with various embodiments may comprise a supply manifold mounted on an outer surface of an engine case surrounding the gas turbine engine section, wherein the supply manifold comprises a first cooling zone having a first arrangement of first cooling holes and a second cooling zone having a second arrangement of cooling holes, wherein the first arrangement of first cooling holes is different from the second arrangement of second cooling holes. At least one of the first cooling holes may be a different size than at least one of the second cooling holes. Further, the engine case may comprise a high pressure turbine case.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

The detailed description of embodiments herein makes reference to the accompanying drawings, which show embodiments by way of illustration. While these embodiments are described in sufficient detail to enable those skilled in the art to practice the inventions, it should be understood that other embodiments may be realized and that logical and mechanical changes may be made without departing from the spirit and scope of the disclosure. Thus, the detailed description herein is presented for purposes of illustration only and not for limitation. For example, any reference to singular includes plural embodiments, and any reference to more than one component or step may include a singular embodiment or step. Also, any reference to attached, fixed, connected or the like may include permanent, removable, temporary, partial, full and/or any other possible attachment option.

Among other features, this disclosure relates to active clearance control systems utilizing improved manifolds. Improved manifolds may utilize multiple cooling zones to provide additional or reduced cooling to specific portions of an engine case.

Figure 1:
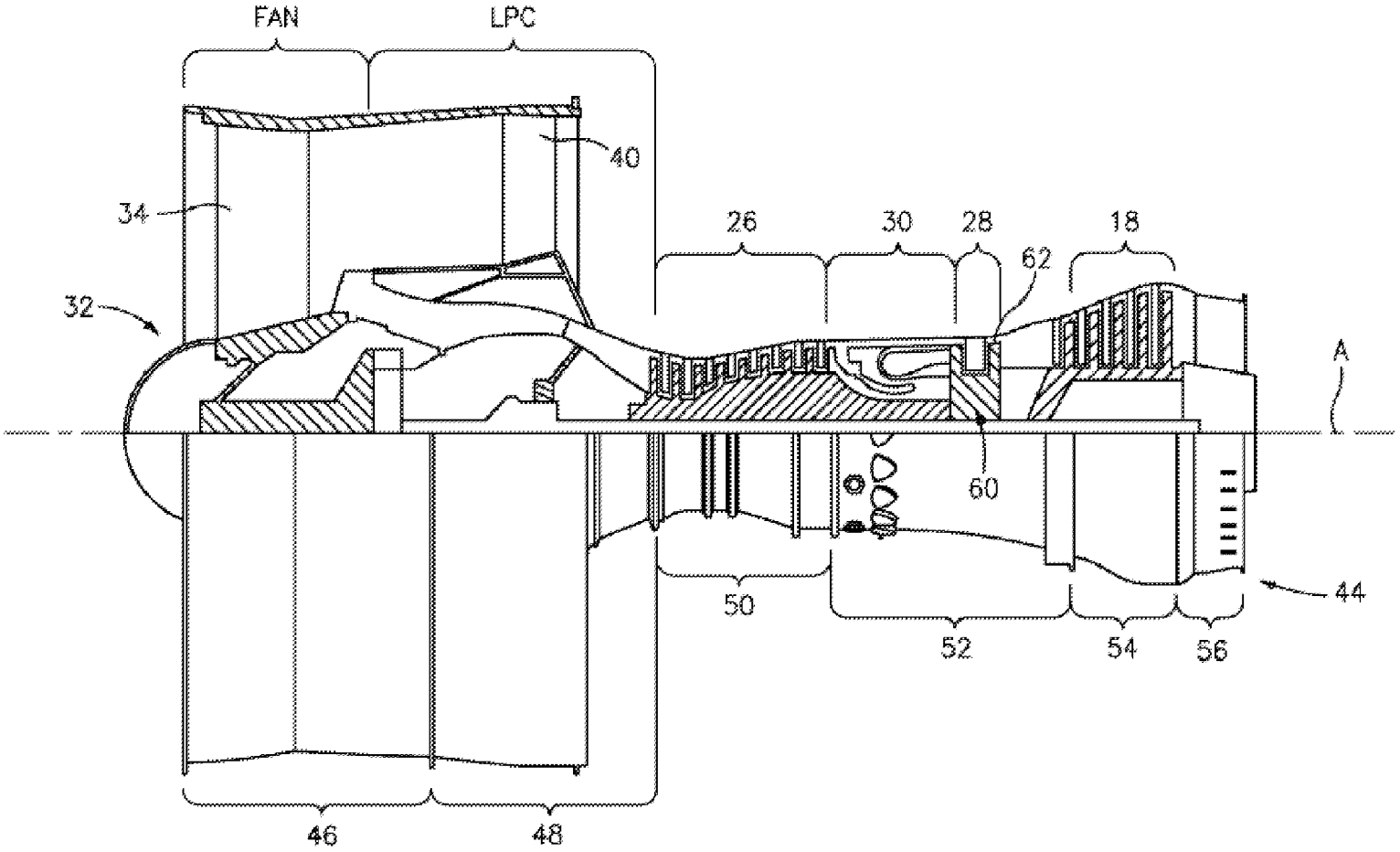
FIG. 1 illustrates, in accordance with various embodiments, a side view of a gas turbine engine.

Accordingly, with reference to FIG. 1, a gas turbine engine 20 is shown. In general terms, gas turbine engine 20 may comprise a compressor section 24. Air may flow through compressor section 24 and into a combustion section 26, where it is mixed with a fuel source and ignited to produce hot combustion gasses. These hot combustion gasses may drive a series of turbine blades within, for example, a high pressure turbine section 28, which in turn drive, for example, one or more compressor section blades mechanically coupled thereto.

Each of compressor section 24 and high pressure turbine section 28 may include alternating rows of rotor assemblies and vane assemblies (shown schematically) that carry airfoils that extend into the core flow path C. For example, the rotor assemblies may carry a plurality of rotating blades 25, while each vane assembly may carry a plurality of vanes 27 that extend into the core flow path C. Blades 25 create or extract energy (in the form of pressure) from the core airflow that is communicated through gas turbine engine 20 along the core flow path C. Vanes 27 direct the core airflow to blades 25 to either add or extract energy.

Figure 2:
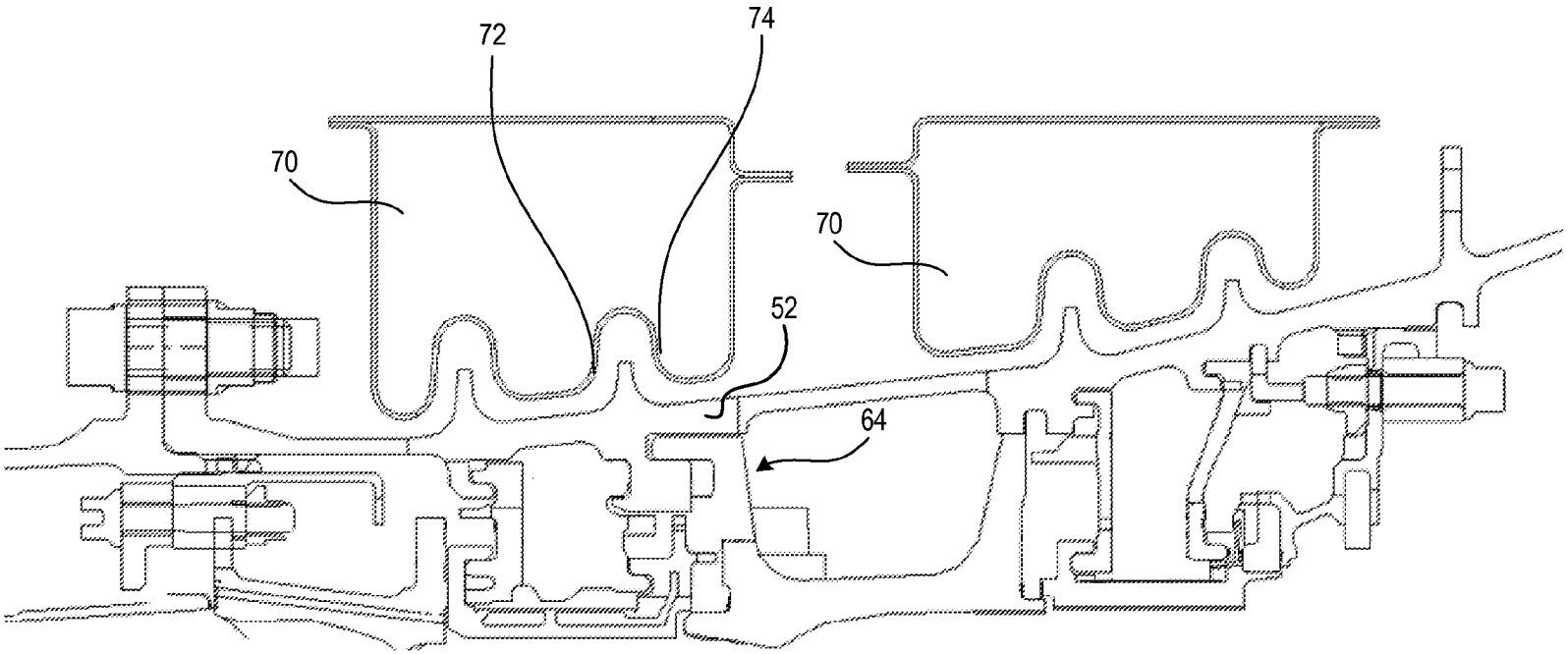
FIG. 2 illustrates, in accordance with various embodiments, a cross sectional view of an engine section of a gas turbine engine.

In various embodiments, high pressure turbine section 28 includes a turbine rotor 60 with a plurality of circumferentially spaced radially outwardly extending turbine blades 25. With reference to FIG. 2, turbine blades 25 may rotate within a shroud structure 64 which is supported within high pressure turbine case 52. In various embodiments, shroud structure 64 is circumferentially segmented and mounted to high pressure turbine case 52. Tip clearance may be defined as the spacing between the tip of a turbine blade 25 and shroud structure 64. Tip clearance of turbine blades 25 may be controlled through an active clearance control (ACC) system 66 surrounding the high pressure turbine case 52. It should be understood that the embodiment is illustrated within high pressure turbine case 52, however other cases including, for example, a fan case 46, an intermediate case (IMC) 48, a high pressure compressor case 50, a low pressure turbine case 54, and an exhaust case 56 may also benefit from ACC system 66.

ACC system 66 may further comprise a supply manifold 70 generally located adjacent and concentrically an engine case (e.g., high pressure turbine case 52) and configured to distribute cooling airflow thereto from a source such as a fan or compressor section. As will be discussed in greater detail, supply manifold 70 may comprise a plurality of cooling holes capable of passing cooling air through supply manifold 70 to turbine case 52.

During operation of engine 20, high pressure turbine case 52 may elevate in temperature and, in turn, the shape of case 52 may change. For example, while not in operation, high pressure turbine case 52 may be relatively cylindrical. As various sections of high pressure turbine case 52 become hotter than others, the shape may distort and turbine case 52 may become non cylindrical. Such distortion may reduce tip clearance in localized areas of increased temperature, and in some cases, may cause blade 25 to contact case 52. In various embodiments, supply manifold 70 may be tailored to provide different levels of cooling to different sections of high pressure turbine case 52, which may reduce the distortion of the shape of case 52. By reducing the distortion of case 52, more consistent tip clearances may be achieved and maintained.

Figure 3A:
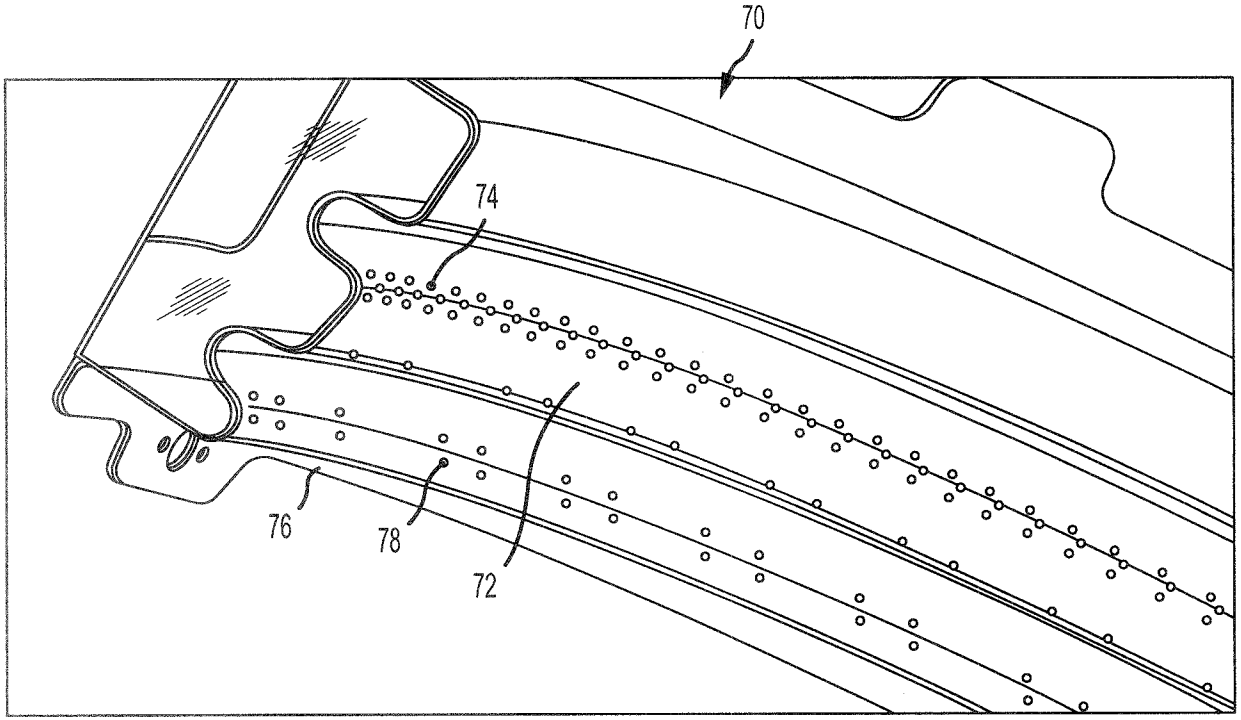
FIGS. 3A and 3B illustrate, in accordance with various embodiments, perspective views of an active clearance control system.
Figure 3B:
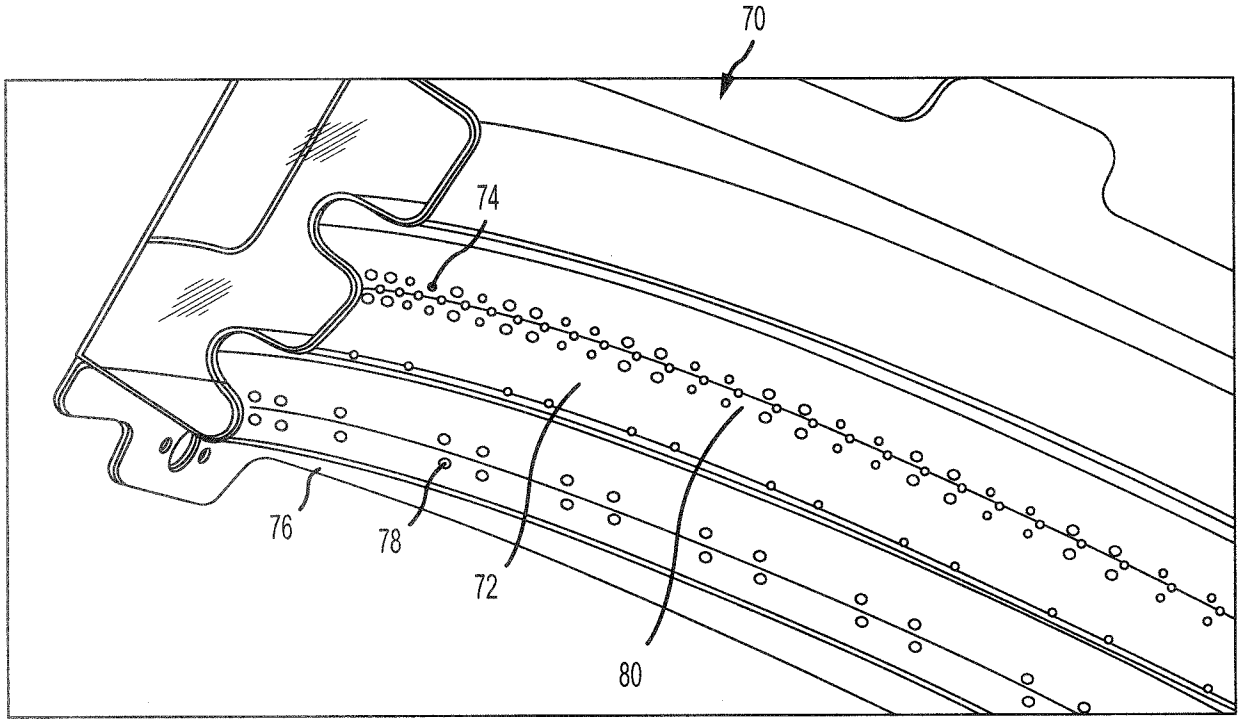

With reference to FIGS. 2, 3A, and 3B, in various embodiments, supply manifold 70 may comprise a first cooling zone 72. First cooling zone 72 may comprise a first arrangement of cooling holes 74. For example, first cooling zone 72 may comprise a plurality of cooling holes spaced apart from one another. In various embodiments, various holes of first arrangement of cooling holes 74 may have a different size or shape from one another. In further embodiments, all the holes of first arrangement of cooling holes 74 comprise the same size and shape. Any configuration of first cooling zone, including any number, shape, size, and distribution of cooling holes, is with the scope of the present disclosure.

Supply manifold 70 may further comprise a second cooling zone 76. Similar to first cooling zone 72, second cooling zone 76 may comprise a second arrangement of cooling holes 78. The various holes of second arrangement of cooling holes 78 may have a different size or shape from one another, or may comprise the same size and shape as each other. Any configuration of second cooling zone, including any number, shape, size, and distribution of cooling holes, is with the scope of the present disclosure.

In various embodiments, with reference to FIG. 3B, first arrangement of cooling holes 74 and second arrangement of cooling holes 78 are different from one another. The position, number of holes, size of holes, shape of holes, and distribution of holes in first arrangement of cooling holes 74 and second arrangement of cooling holes 78 may be selected to provide predetermined amounts of cooling to various portions of turbine case 52. The distribution of holes in first arrangement of cooling holes 74 and second arrangement of cooling holes 78 may vary axially and/or circumferentially from each other.

For example, first cooling zone 72 (comprising first arrangement of cooling holes 74) may be located at or near a position of turbine case 52 that may benefit from more cooling than a position of turbine case 52 at which second cooling zone 76 is positioned. In such embodiments, first arrangement of cooling holes 74 may include more holes and/or larger holes than second arrangement of cooling holes 78. Stated another way, in such embodiments, first arrangement of cooling holes 74 may include a greater total surface area of holes than second arrangement of cooling holes 78. Similarly, second cooling zone 76 (comprising second arrangement of cooling holes 78) may be located at or near a position of turbine case 52 that may benefit from less cooling than a position of turbine case 52 at which second cooling zone is positioned.

In various embodiments, engine 20 may comprise more than one ACC system 66. For example, two or more ACC systems 66 may be used in a single engine section, such as high pressure turbine section 28. Further, ACC systems 66 may be used in multiple engine sections. Additionally, within a given ACC system 66, any number of cooling zones and cooling hole arrangements may be used, including combining and/or overlaying one or more cooling zones or arrangements, to achieve a desired amount cooling to the engine case. For example, overlaying cooling zones or arrangements can be seen with reference to FIG. 3B where cooling zone 72 is overlayed with cooling zone 76 to form overlayed cooling zone 80. The use of any number of similar or different ACC systems 66 within engine 20 is within the scope of the present disclosure.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the inventions. The scope of the inventions is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. An active clearance control system, comprising;

an engine case comprising an outer surface; and a supply manifold mounted on the outer surface of the engine case and having a first cooling zone comprising a first arrangement of first cooling holes and a second cooling zone comprising a second arrangement of cooling holes, wherein the first arrangement of first cooling holes comprises a different shape of cooling holes and a different distribution of cooling holes from the second arrangement of second cooling holes, wherein the first cooling zone and the second cooling zone overlay each other for a portion of the engine case.

2. The active clearance control system of claim 1, wherein the first arrangement of first cooling holes comprises a greater number of first cooling holes than the second arrangement of second cooling holes.

3. The active clearance control system of claim 1, wherein at least one of the first cooling holes is larger than at least one of the second cooling holes.

4. The active clearance control system of claim 1, wherein the engine case comprises a high pressure turbine case.

5. The active clearance control system of claim 1, further comprising a rotor having a plurality of blades adjacent to a shroud coupled to an inner surface of the engine case.

6. The active clearance control system of claim 5, wherein a tip clearance is defined by a distance between the plurality of blades and the inner surface of the engine case.

7. A gas turbine engine, comprising:

a turbine section including an engine case comprising an outer surface; and a supply manifold mounted on the outer surface of the engine case surrounding the turbine section, wherein the supply manifold comprises a first cooling zone having a first arrangement of first cooling holes and a second cooling zone having a second arrangement of cooling holes, wherein the first arrangement of first cooling holes comprises a different shape of cooling holes and a different distribution of cooling holes from the second arrangement of second cooling holes, wherein the first cooling zone and the second cooling zone overlay each other for a portion of the engine case.

8. The gas turbine engine of claim 7, wherein the first arrangement of first cooling holes comprises a greater number of first cooling holes than the second arrangement of second cooling holes.

9. The gas turbine engine of claim 7, wherein the first arrangement of first cooling holes comprises fewer first cooling holes than the second arrangement of second cooling holes.

10. The gas turbine engine of claim 7, wherein at least one of the first cooling holes are larger than at least one of the second cooling holes.

11. The gas turbine engine of claim 7, wherein the engine case comprises a high pressure turbine case.

12. The gas turbine engine of claim 7, wherein the engine case comprises a low pressure turbine case.

13. The gas turbine engine of claim 7, further comprising a rotor having a plurality of blades adjacent to a shroud coupled to an inner surface of the engine case.

14. The gas turbine engine of claim 13, wherein a tip clearance is defined by the plurality of blades and the inner surface of the engine case.

15. The gas turbine engine of claim 7, wherein the engine case comprises a high pressure turbine case.

16. A gas turbine engine section, comprising:

a supply manifold mounted on an outer surface of an engine case surrounding the gas turbine engine section, wherein the supply manifold comprises a first cooling zone having a first arrangement of first cooling holes and a second cooling zone having a second arrangement of cooling holes, wherein the first arrangement of first cooling holes comprises a different shape of cooling holes and a different distribution of cooling holes from the second arrangement of second cooling holes, wherein the first cooling zone and the second cooling zone overlay each other for a portion of the engine case.

17. The gas turbine engine section of claim 16, wherein the first arrangement of first cooling holes comprises a different number of first cooling holes than the second arrangement of second cooling holes.

18. The gas turbine engine section of claim 16, wherein at least one of the first cooling holes is a different size than at least one of the second cooling holes.

* * * * *